US005474287A

United States Patent [19]

Takahashi

[11] Patent Number: 5,474,287

[45] Date of Patent: Dec. 12, 1995

[54] SHEET FEEDING APPARATUS

[75] Inventor: Koji Takahashi, Yokohama, Japan

[73] Assignee: Canon Kabushiki Kaisha, Tokyo, Japan

[21] Appl. No.: 391,080

[22] Filed: Feb. 21, 1995

Related U.S. Application Data

[63] Continuation of Ser. No. 58,757, May 10, 1993, abandoned.

[30] Foreign Application Priority Data

May 13, 1992 [JP] Japan ..... 4-120710

[51] Int. Cl.[6] ..... B65H 5/00

[52] U.S. Cl. ..... 271/10.13; 271/116; 271/117; 271/122; 271/124; 271/10.11

[58] Field of Search ..... 271/4, 10, 114, 271/116, 117, 121, 122, 124, 125

[56] References Cited

U.S. PATENT DOCUMENTS

| | | | |
|---|---|---|---|
| 2,995,362 | 8/1961 | Levy et al. | 271/36 |
| 4,368,881 | 1/1983 | Landa | 271/122 |
| 4,552,352 | 11/1985 | Nickels, Jr. et al. | 271/10 |
| 4,627,607 | 12/1986 | Ishii | 271/122 |
| 4,709,911 | 12/1987 | Saiki et al. | 271/10 |
| 4,796,035 | 1/1989 | Kawasaki et al. | 346/108 |
| 4,801,134 | 1/1989 | Yokoyama et al. | 271/122 |
| 5,127,644 | 7/1992 | Yoshihiro | 271/10 |
| 5,152,519 | 10/1992 | Ifkovits, Jr. | 271/10 |

FOREIGN PATENT DOCUMENTS

| | | | |
|---|---|---|---|
| 0116895A3 | 8/1984 | European Pat. Off. . | |
| 0515000A1 | 11/1992 | European Pat. Off. . | |
| 2329563 | 5/1977 | France . | |
| 3337451A1 | 4/1984 | Germany . | |
| 0052832 | 4/1980 | Japan | 271/122 |
| 59-108631 | 6/1984 | Japan . | |
| 60-188248 | 9/1985 | Japan . | |
| 61-81333 | 4/1986 | Japan . | |
| 241487 | 9/1990 | Japan . | |

*Primary Examiner*—William E. Terrell
*Assistant Examiner*—Carol L. Druzbick
*Attorney, Agent, or Firm*—Fitzpatrick, Cella, Harper & Scinto

[57] ABSTRACT

A sheet feeding apparatus having a sheet support for supporting a plurality of sheets, a separating roller rotated in a direction for feeding the sheets, a reversely rotatable roller rotatably supported by a rockably provided reversely rotatable roller holder and bearing against the separating roller, drive force transmitter for transmitting to the reversely rotatable roller a drive force for rotating the reversely rotatable roller in the direction opposite to the direction for feeding the sheets, and a torque limiter provided on the drive force transmitter for cutting off the transmission of a driving torque of a predetermined torque value or greater.

13 Claims, 8 Drawing Sheets

SHEET FEEDING APPARATUS

This application is a continuation of application Ser. No. 08/058,757, filed May 10, 1993, now abandoned.

BACKGROUND OF THE INVENTION

1. Field of the Invention

This invention relates to a sheet feeding apparatus for separating and feeding originals or recording sheets one by one in a facsimile apparatus, a copying apparatus, a printer or the like.

2. Related Background Art

As a separating system for separating and feeding sheets one by one in a sheet feeding apparatus, there is widely known a reversely rotatable roller type sheet feeding apparatus using a reversely rotatable roller to which drive is transmitted through a torque limiter or a device functionally similar to a torque limiter. As such reversely rotatable roller type sheet feeding apparatus, there has been proposed a device in which, as described in U.S. Pat. No. 4,368,881 or Japanese Patent Publication No. 2-41487, the pressure contact force between a reversely rotatable roller and a separating roller bearing against it is automatically adjusted in conformity with the strength or weakness of the limit value of a torque limiter (which is created by irregularity or the like in manufacture or use).

The reversely rotatable roller type separation shown in U.S. Pat. No. 4,368,881 will be described here with reference to FIG. 12 of the accompanying drawings. A reversely rotatable roller R rockable by an arm 101 is urged against a separating roller F by a spring 102, and a drive force is transmitted from the pivot shaft 103 of the arm 101 to the reversely rotatable roller R through gears 104 and 105.

In this construction, when the drive force is transmitted to the reversely rotatable roller R, a moment in a direction for urging the reversely rotatable roller R toward the separating roller F is created in the arm 101 by a drive transmitting force and further, a moment for urging the reversely rotatable roller R against the separating roller F is created by a frictional force the reversely rotatable roller R receives directly or indirectly through a sheet from the separating roller F.

Accordingly, in such a construction, both of the drive transmitting force and the frictional force create a force which urges the reversely rotatable roller R against the separating roller F.

Describing the reversely rotatable roller type separation shown in Japanese Patent Publication No. 2-41487 with reference to FIG. 13 of the accompanying drawings, a reversely rotatable roller R has its shaft 106 slidably engaged with a groove 107*a* in a side plate 107 and is vertically movably provided, and is urged against a separating roller F by gravity. A drive transmitting force is transmitted to the reversely rotatable roller R by a belt 108.

In this construction, when a drive force is transmitted from the belt 108 to the reversely rotatable roller R, a force which urges the reversely rotatable roller R toward the separating roller F is created by the drive transmitting force. Also, a force which spaces the reversely rotatable roller R apart from the separating roller F is created by a frictional force the reversely rotatable roller R receives directly or indirectly through a sheet from the separating roller F. Also, the drive transmitting force creates a force which urges the reversely rotatable roller R against the separating roller F and conversely, the frictional force creates a force which spaces the reversely rotatable roller R apart from the separating roller F.

In the construction shown in the aforementioned U.S. Pat. No. 4,368,881, however, both of the drive transmitting force to the reversely rotatable roller R and the frictional force the reversely rotatable roller R receives from the separating roller F act to urge the reversely rotatable roller R against the separating roller F and therefore, the pressure contact force between the reversely rotatable roller R and the separating roller F sometimes becomes too strong, and if the pressure contact force is too strong, the limit value of the torque limiter will have to be set high in conformity therewith. However, if the limit value of the torque limiter is set high, a sheet conveying portion disposed at the downstream side will have to draw out a sheet against this strong pressure contact force and therefore, the conveyance speed will become irregular or a drive motor will cause a loss of synchronism, and this will lead to the problem that poor reading of originals and poor sheet feed are caused. Yet, if the conveying force of the conveying portion is set to a great level, it will give rise to problems such as the bulkiness of the motor and an increase in a driving current.

Also, in the construction shown in Japanese Patent Publication No. 2-41478, the frictional force the reversely rotatable roller receives from the separating roller acts to space the reversely rotatable roller apart from the separating roller and correspondingly thereto, it becomes difficult for bad conveyance by an increase in the pressure contact force to occur, but conversely, the reversely rotatable roller becomes liable to separate from the separating roller and separation cannot be sufficiently accomplished and double feed becomes liable to occur. So, it becomes necessary to provide a spring or the like of a strong biasing force discretely to urge the reversely rotatable roller against the separating roller, and in such case, unless the setting or the like of the spring force is accurately done, the force with which the reversely rotatable roller is urged against the separating roller will become too strong, and this will give rise to the same problem as in the above-mentioned U.S. Pat. No. 4,368,881.

SUMMARY OF THE INVENTION

The present invention has been made in view of the above-noted problems and the object thereof is to provide a reversely rotatable roller type sheet feeding apparatus improved in the sheet separating performance.

A feature of the present invention is that in a sheet feeding apparatus provided with sheet supporting means for supporting a plurality of sheets, a separating roller rotatable in a direction for feeding the sheets, a reversely rotatable roller rotatably supported by a rockably provided reversely rotatable roller holder and bearing against said separating roller, drive force transmitting means for transmitting to said reversely rotatable roller a drive force for rotating said reversely rotatable roller in the direction opposite to the direction for feeding the sheets, and a torque limiter provided on said drive force transmitting means for cutting off the transmission of a driving torque of a predetermined torque value or greater, a moment in a direction for spacing said reversely rotatable roller apart from said separating roller is created in said reversely rotatable roller holder by the drive force from said drive force transmitting means transmitted to said reversely rotatable roller and a moment in a direction in which said reversely rotatable roller is urged against said separating roller is created in said reversely rotatable roller holder by a frictional force said reversely rotatable roller receives from said separating roller.

According to this construction, a moment in the direction for spacing the reversely rotatable roller apart from the separating roller is created in the reversely rotatable roller holder by the drive force applied to the reversely rotatable roller, and a moment in the direction for urging the reversely rotatable roller against the separating roller is created in the reversely rotatable roller holder by the frictional force the reversely rotatable roller receives from the separating roller and therefore, the pressure contact force between the reversely rotatable roller and the separating roller is moderately adjusted. Accordingly, the separating performance is improved and reliable separation and feeding of the sheets can be accomplished and also, the conveying force of conveying means disposed at the downstream side can be set small and thus, the compactness and low cost of the apparatus can be achieved.

A further feature of the present invention resides in a sheet feeding apparatus provided with:

sheet supporting means for supporting sheets;

separating means for separating the sheets fed from said sheet supporting means one by one, said separating means being comprised of a separating roller rotated in a sheet feeding direction, and a reversely rotatable roller bearing against said separating roller and rotatable in the direction opposite to the sheet feeding direction;

conveying means for conveying the sheets separated by said separating means, said conveying means being comprised of a feed roller rotated in the sheet feeding direction, and a pinch roller rotatably supported by a rockably provided pinch roller holder and bearing against said feed roller;

drive force transmitting means for transmitting the drive force of said conveying means to the reversely rotatable roller of said separating means; and a torque limiter provided on said drive force transmitting means for cutting off the transmission of any driving torque of a predetermined torque value or greater to said reversely rotatable roller;

the bearing pressure of said pinch roller against said feed roller being varied in conformity with a variation in said predetermined torque value in said torque limiter.

According to this construction, when the limit value of the torque limiter is varied by any irregularity or the like occurring in manufacture or in use, the pressure with which the pinch roller of the conveying means disposed at the downstream side bears against the feed roller automatically varies and therefore, an optimum conveying force can be set in conformity with a variation in the limit value.

DESCRIPTION OF THE PREFERRED EMBODIMENTS

Figure 1:
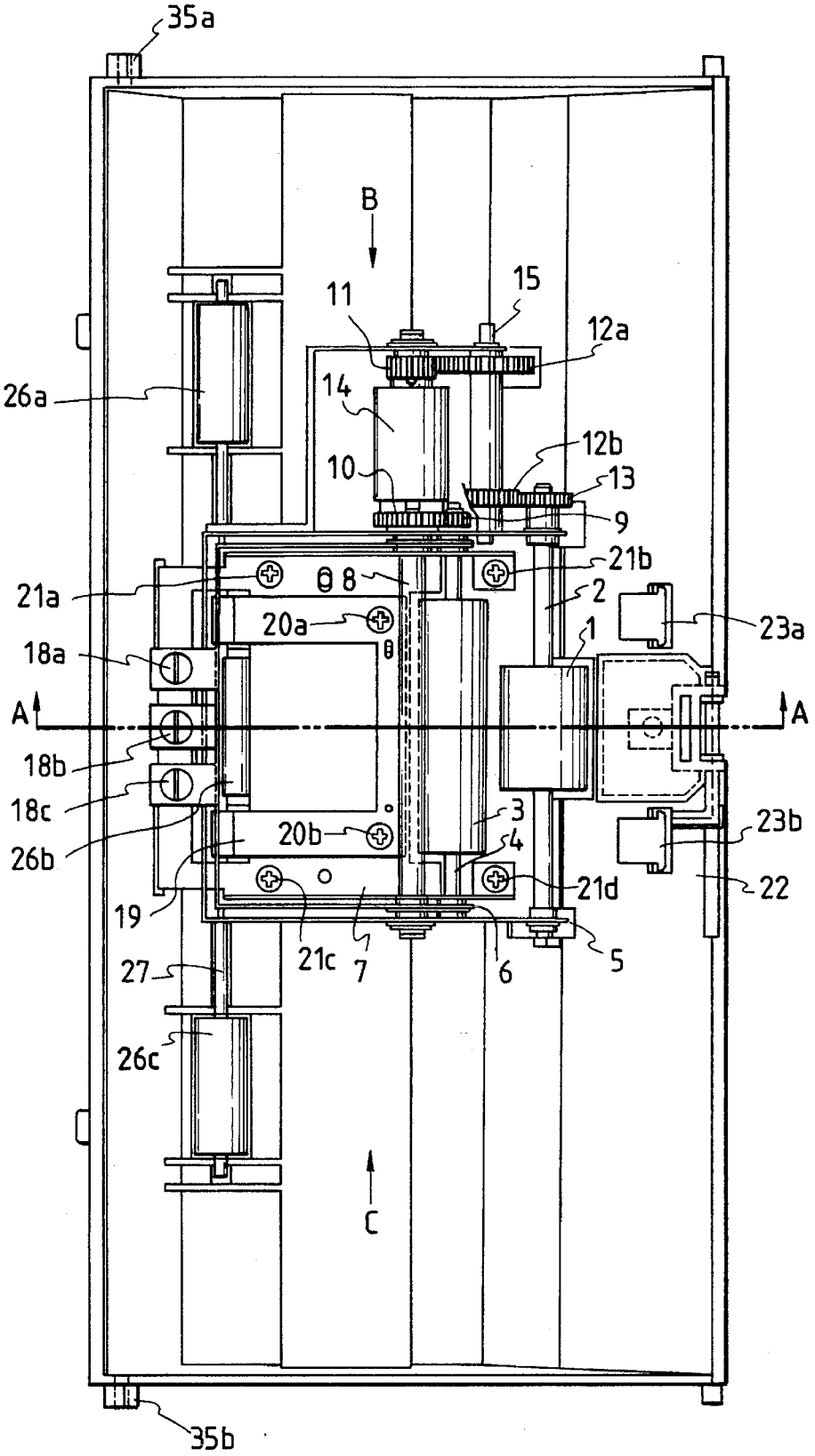
FIG. 1 is a plan view of the automatic original feeding apparatus of a facsimile apparatus which embodies the present invention.
Figure 2:
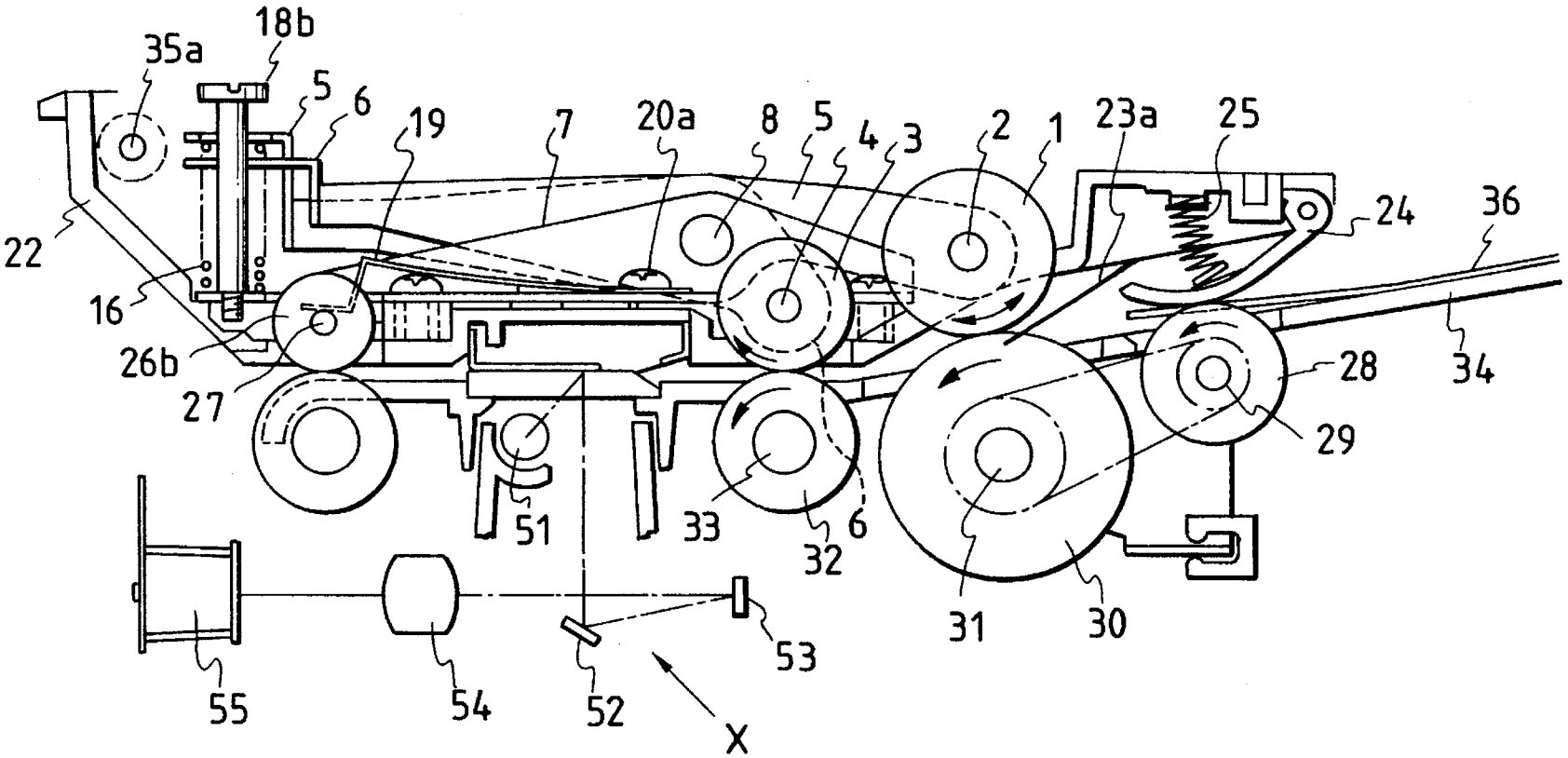
FIG. 2 is a cross-sectional view taken along the line A—A of FIG. 1.
Figure 3A:
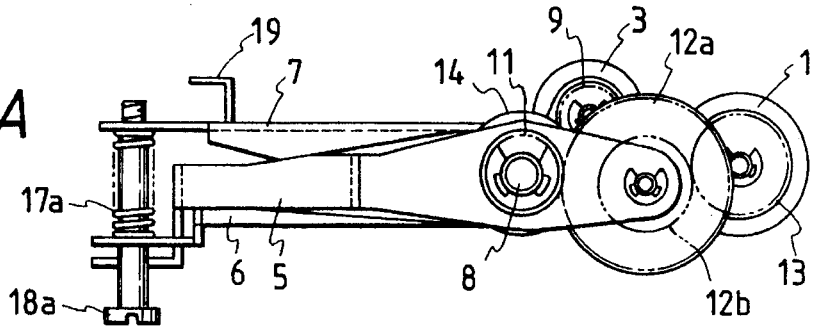
FIG. 3A is a view taken along the arrow B of FIG. 1.
Figure 3B:
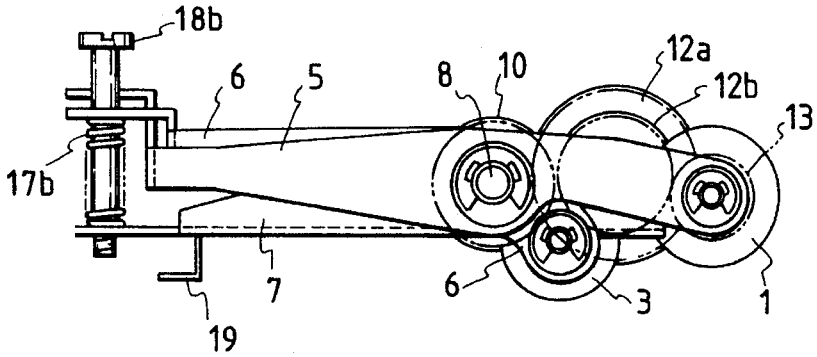
FIG. 3B is a view taken along the arrow C of FIG. 1.
Figure 4:
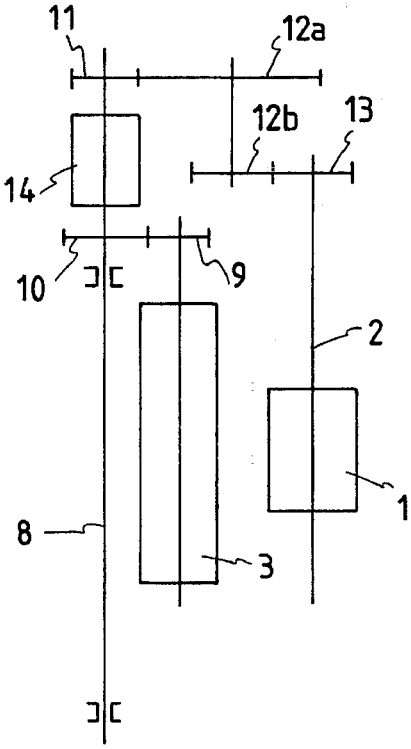
FIG. 4 is a schematic view showing a gear train shown in FIG. 1.

FIG. 1 is a plan view showing a case where the present invention is applied to a facsimile apparatus and the epitome of a region for feeding sheet originals to an image reading portion X, FIG. 2 is a cross-sectional view taken along the line A—A of FIG. 1, FIG. 3A is a view of essential portions taken along the arrow B of FIG. 1, FIG. 3B is a view of essential portions taken along the arrow C of FIG. 1, and FIG. 4 shows the arrangement of gears.

In these figures, the reference numeral 1 designates a reversely rotatable roller, 2 denotes the shaft of the reversely rotatable roller, 3 designates a pinch roller made of EPDM (ethylene-propylene-diene-rubber) having a high coefficient of friction, 4 denotes the shaft of the pinch roller, 5 designates a reversely rotatable roller holder for holding the shaft 2 of the reversely rotatable roller through a bearing, and 6 denotes a pinch roller holder for holding the shaft 4 of the pinch roller through a bearing.

The reference numeral 7 designates a frame, 8 denotes a support shaft for rotatably holding the reversely rotatable roller holder 5, the pinch roller holder 6 and the frame 7, and 9, 10, 11, 12*a*, 12*b* and 13 designate gears for transmitting drive from the shaft 4 of the pinch roller to the shaft 2 of the reversely rotatable roller. The numbers of the teeth of these gears are set to 16, 33, 22, 47-29 and 27, respectively.

The reference numeral 14 denotes a torque limiter, 15 designates the rotational support shaft of the gears 12*a* and 12*b*, 16 denotes a reversely rotatable roller spring for biasing the reversely rotatable roller 1 through the reversely rotatable roller holder 5, 17*a* and 17*b* designate pinch roller springs for biasing the pinch roller 3 through the pinch roller holder 6, 18*a*, 18*b* and 18*c* denote stoppers for regulating the rotation of the reversely rotatable roller holder 5 and pinch roller holder 6, and 19 designates a leaf spring attached to the frame 7 by means of screws 20*a* and 20*b* and biasing rollers 26*a*, 26*b* and 26*c* through a roller shaft 27.

The above-described parts 1–20 together constitute an independent unit (hereinafter referred to as a "reversely rotatable roller unit") which is mounted on an upper original guide 22 by means of screws 21*a*, 21*b*, 21*c* and 21*d*.

Further, the reference characters 23*a* and 23*b* denote guides of a low rigidity material disposed at the right and left of the reversely rotatable roller 1, 24 designates an urging arm, and 25 denotes an urging arm spring for biasing the urging arm against a preliminary conveying roller 28. The above-described parts 1–27 together constitute a unit (hereinafter referred to as an "upper original guide unit") in which the reversely rotatable roller unit is mounted on the upper original guide 22.

In FIG. 2, the reference numeral 29 designates a preliminary conveying roller shaft for rotatably supporting the preliminary conveying roller 28, 30 denotes a separating roller, 31 designates the shaft of the separating roller, 32 denotes a feed roller, 33 designates the shaft of the feed roller, and 34 denotes a lower original guide which is a sheet stand. The upper original guide unit is pivotably supported on the body frame, not shown, of the facsimile apparatus by fulcrums 35*a* and 35*b* provided on a portion of the upper original guide 22, and is held at a predetermined level relative to the lower original guide 34 by lock means (not shown).

Figure 5:
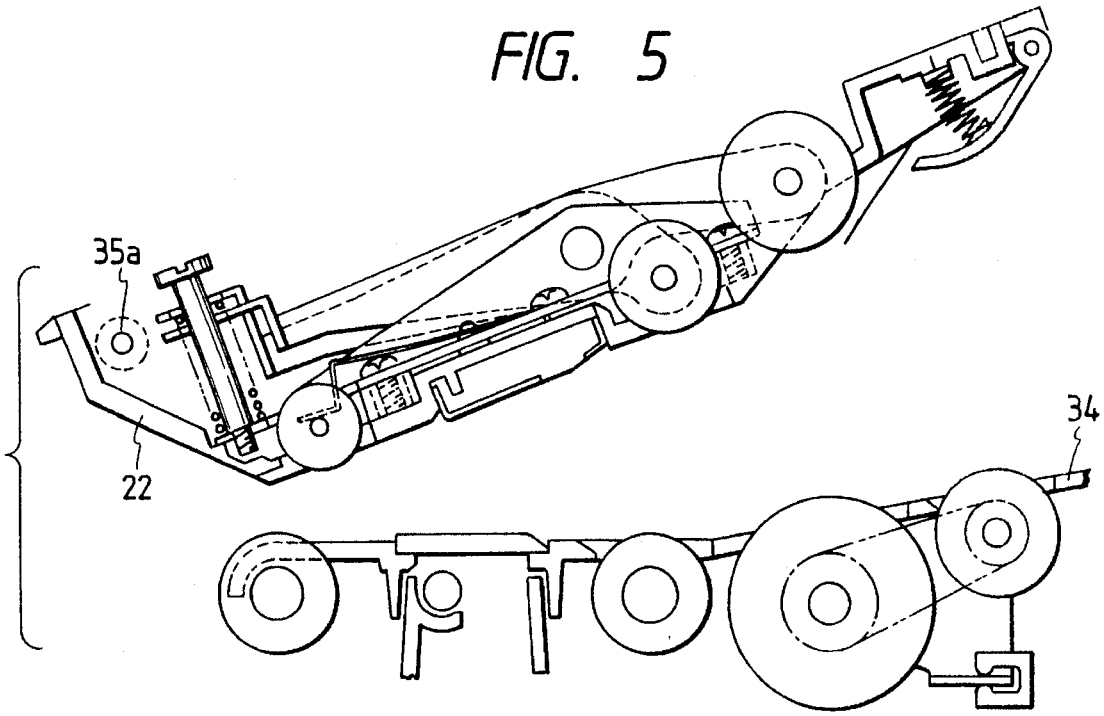
FIG. 5 shows an upper original guide unit in the apparatus shown in FIG. 1 as it is raised.

Design is made such that when the lock means (not shown) is unlocked, the upper original guide unit can be raised as shown in FIG. 5. When conversely, the upper original guide unit is lowered and the lock means (not shown) is locked, the reversely rotatable roller 1 and the pinch roller 3 bear against the separating roller 30 and the feed roller 32, respectively, thereby constituting a reversely rotatable roller type sheet feeding apparatus. The reference numeral 36 designates a sheet original.

The separating roller 30 and the feed roller 32 are driven in the direction of arrow in FIG. 2 by a drive source, not shown. Also, the torque limiter 14 is set so as to slip when a load torque of a certain set value TR or greater is applied to the reversely rotatable roller 1.

Further, when the frictional forces between the rollers or between the rollers and the sheet are defined as follows:

friction the reversely rotatable roller 1 and the separating roller 30 F1 friction between the pinch roller 3 and the feed roller 32 F2 friction between the reversely rotatable roller 1 and the sheet 36 F3 friction between the separating roller and the sheet 36 F4 friction between two sheets 36 F5 friction between the pinch roller 3 and the sheet 36 F6 friction between the feed roller 32 and the sheet 36 F7 and the radii of the reversely rotatable roller 1 and the pinch roller 3 are r1 and r2, respectively, and the speed reduction ratio of the gear train from the pinch roller 3 to the reversely rotatable roller 1 is η, the above-mentioned values are set by the pinch roller springs 17*a* and 17*b* so as to be $$F1r1>TR \quad \text{(i)}$$

$$F3r1>TR>F5r1 \quad \text{(ii)}$$

$$F4>F5 \quad \text{(iii)}$$

$$\eta F2r2>TR \quad \text{(iv)}$$

$$\eta F6r2>TR \quad \text{(v)}$$

$$\eta F7r2>TR \quad \text{(vi)}$$

and therefore, the present reversely rotatable roller type sheet feeding apparatus with the torque limiter operates as follows in conformity with the setting of the sheet original 36 onto the lower original guide 34.

(1) When there is no sheet:

By (i) and (iv), the reversely rotatable roller 1 and the pinch roller 3 are rotated with the separating roller 30 and the feed roller 32, respectively, and the torque limiter 14 slips.

(2) When t here i s one sheet:

By (ii) (F3r1>TR), (v) and (vi), the reversely rotatable roller 1 and the pinch roller 3 are rotated with the separating roller 30 and the feed roller 32, respectively, through the sheet, and the torque limiter 14 slips (performs the same operation as (1)).

(3) When there are two or more sheets:

By (ii), (iii), (v) and (vi), the pinch roller 3 rotates with the feed roller 32, and the reversely rotatable roller 1 is reversely rotated to return the other sheet or sheets than the lowermost sheet to upstream in the sheet conveying direction. The torque limiter 14 does not slip.

Figure 6:
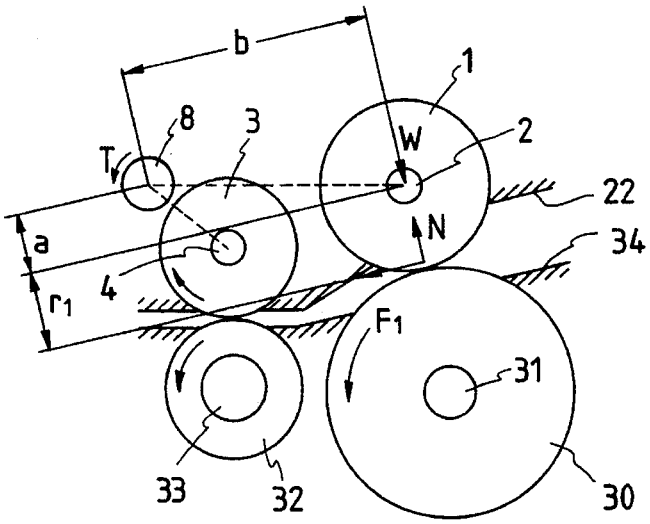
FIG. 6 shows the essential portions of FIG. 2.

Now, the action of automatically adjusting the pressure contact force of the reversely rotatable roller will be described here in detail with reference to FIG. 6. FIG. 6 shows the essential portions of FIG. 2, and in this figure, the letter T indicates a torque with which the gear 11 drives the gear 12*a*, and when the speed reduction ratio from the gear 11 to the gear 13 via the gears 12*a* and 12*b* is η1, T is represented by $$T=\frac{1}{\eta 1}\,TR.$$

F1 is a frictional force the reversely rotatable roller 1 receives from the separating roller 30, W is the pressure contact force by the reversely rotatable roller spring 16, N is a vertical drag the reversely rotatable roller 1 receives from the separating roller 30, a is the distance from the support shaft 8 to a straight line passing through the center of the shaft 2 of the reversely rotatable roller and parallel to the tangential line between the reversely rotatable roller 1 and the separating roller 30, and b is the distance from the support shaft 8 to a straight line passing through the centers of the shaft 2 of the reversely rotatable roller and the shaft 31 of the separating roller.

Let it now be assumed that the separating roller 30 is driven in the direction of arrow in FIG. 6 and a frictional force F1 is created and as previously described, the reversely rotatable roller 1 rotates with the separating roller 30 and the torque limiter is slipping. In this state, F1 tends to rotate the reversely rotatable roller 1 in a clockwise direction (a direction in which the roller 1 is urged against the separating roller 30) with respect to the support shaft 8 with a torque of F1(r1+a) and rotate the gear 11 in a counter-clockwise direction (a direction away from the separating roller 30) with a torque of $$T=\frac{1}{\eta 1}\,TR$$

and therefore, the balance of the moment of the reversely rotatable roller 1 about the support shaft 8 is $$(N-W)b-F1(r1+\underline{a})+\frac{1}{\eta 1}\,TR=0$$

Solving this with respect to N, $$N=W+F1\,\frac{r1+a}{b}-\frac{1}{\eta 1 b}\,TR,$$

where F1=1/r1 TR and therefore, when this is substituted for the above equation, $$N = W + \left( \frac{r1 + a}{r1b} - \frac{1}{\eta 1b} \right) TR. \quad \text{(vii)}$$

This equation (vii) is an equation which represents the true pressure contact force N (in the operational state of the rollers) between the reversely rotatable roller 1 and the separating roller 30. As can be seen from the second term in the right side of equation (vii), when the value of TR varies, the value of N also varies. In the present embodiment, $$r1 = 1 \text{ cm}, \underline{a} = 0.4 \text{ cm}, b = 3.1 \text{ cm}$$

$$\eta 1 = \frac{47}{22} \times \frac{27}{29} = 2.0$$

and therefore, $$\begin{aligned} \frac{\Delta N}{\Delta TR} &= \frac{r1 + a}{r1b} - \frac{1}{\eta 1b} \\ &= \frac{1 + 0.4}{1 \times 3.1} - \frac{1}{2.0 \times 3.1} \\ &= 0.45 - 0.16 \\ &= 0.29 \text{ cm}^{-1}. \end{aligned} \quad \text{(viii)}$$

In the above calculation expression, the first term $$\frac{r1 + a}{r1b}$$

(positive) represents that the frictional force the reversely rotatable roller 1 receives from the separating roller 30 acts in a direction for urging the reversely rotatable roller 1 against the separating roller 30, and the second term $$-\frac{1}{\eta 1b}$$

(negative) represents that the drive transmitting force from the support shaft 8 (gear 11) to the drive transmitting means acts in a direction for spacing the reversely rotatable roller 1 apart from the separating roller 30. If this second term is positive, that is, the drive transmitting force from the support shaft 8 (gear 11) to the drive transmitting means acts in the direction for urging the reversely rotatable roller 1 against the separating roller 30, as is expressed by $$\frac{\Delta N}{\Delta TR} = \frac{r1 + a}{r1b} + \frac{1}{\eta 1b} = 0.45 + 0.16 = 0.61 \text{cm}^{-1}, \quad \text{(ix)}$$

the value of $$\frac{\Delta N}{\Delta TR}$$

becomes great as compared with (viii). In any case, $$\frac{\Delta N}{\Delta TR}$$

is positive and therefore, even if the torque limit value TR is fluctuated by the irregularity or the like in the manufacture of the torque limiter 14, N is automatically adjusted in conformity therewith and thus, a normal separating operation can be performed within a wide range of TR. However, as previously described, if the torque limit value TR and the value of the vertical drag N become too great, poor sheet feed or the like will occur and therefore, the range of TR which can be actually used has a predetermined upper limit.

Figure 7:
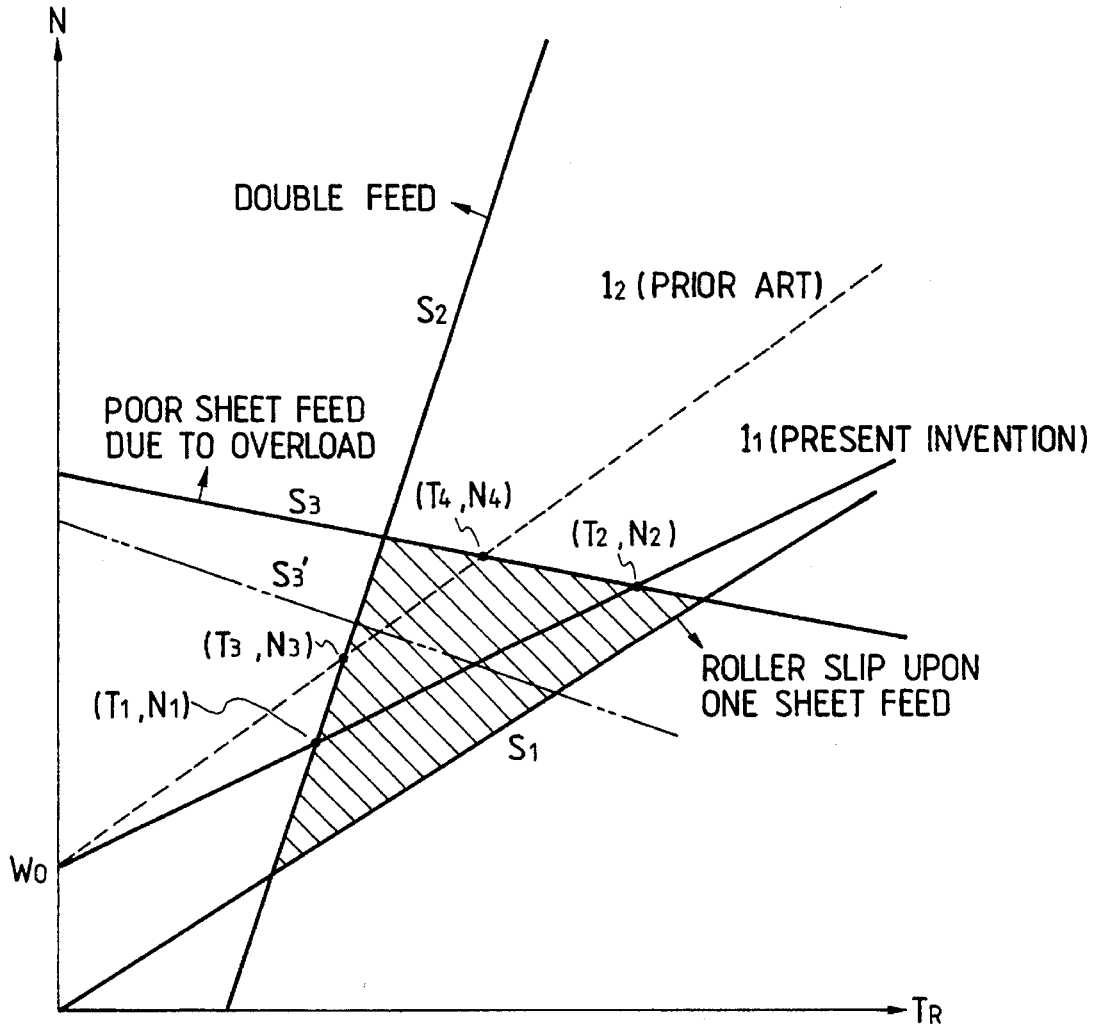
FIG. 7 is a graph showing the ranges of TR and N in which separation and feeding can be normally effected.

This will now be described with reference to FIG. 7. FIG. 7 is a graph showing the ranges of TR and N for which normal separation and feeding can be accomplished. In this figure, the right side from a straight line S1 indicates an area in which during one sheet feed, N becomes deficient and the roller slips, the left side from a straight line S2 indicates an area in which TR becomes deficient and double feed is caused, and $W_0$ indicates the minimum necessary value of the pressure contact force of the reversely rotatable roller 1 when each roller is not driven (the smallest possible value for which the reversely rotatable roller 1 does not float during the setting of sheets). The area in which the value of N becomes too great (overload) and poor sheet feed is caused is the side above a straight line S3. The hatched area encircled by the straight lines S1, S2 and S3 is the area of TR and N in which normal separation and feeding can be accomplished.

In FIG. 7, a straight line $l_1$ represents the afore-described relations (vii) and (viii) between TR and N in the present invention. From this figure, it will be seen that T1 to T2 can be used as the value of TR. On the other hand, a straight line $l_2$ greater in gradient than the straight line $l_1$ represents the relation found from (ix), and only T3 to T4 can be used as the value of TR. That is, by realizing the relation of the straight line $l_1$, the range of the torque limiter 14 which can be used is widened from (T4-T3) to (T2-T1). Further, if required, the values of r1, a, b and η1 may be changed to thereby easily adjust the value of $$\frac{\Delta N}{\Delta TR}$$

Figure 8:
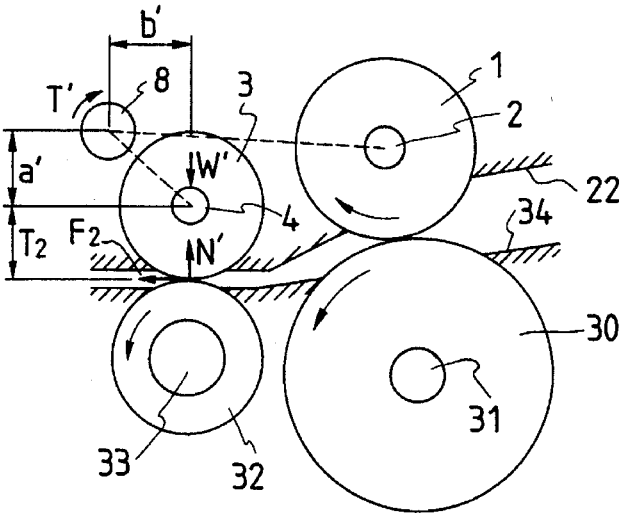
FIG. 8 shows the essential portions of FIG. 2.

The operation of automatically adjusting the pressure contact force of the pinch roller 3 will now be described in detail with reference to FIG. 8. FIG. 8 represents the same portions as those shown in FIG. 6 and the balance of the force (moment) around the pinch roller. In FIG. 8, T' indicates the load torque of the gear 10 relative to the gear 9, and is "a torque with which the gear 10 drives the gear 9" when the drive transmission from the pinch roller 3 to the reversely rotatable roller is seen in the reverse direction and therefore, this T' will hereinafter be called "the torque by the reverse drive transmitting force". T' is identical in magnitude to T and opposite in direction to T, that is, $$T' = -T = -\frac{1}{\eta 1} TR$$

F2 is a frictional force the pinch roller 3 receives from the feed roller 32, W' is a pressure contact force by the pinch roller springs 17*a* and 17*b*, N' is a vertical drag the pinch roller 3 receives from the feed roller 32, a' is the distance from the support shaft 8 to a straight line passing through the center of the shaft 4 of the pinch roller and parallel to the tangential line between the pinch roller 3 and the feed roller 32, and b' is the distance from the support shaft 8 to a straight line passing through the centers of the shaft 4 of the pinch roller and the shaft 33 of the feed roller.

As in the description of the automatic adjustment of the pressure contact force of the reversely rotatable roller, let it be assumed that the feed roller 32 and separating roller 30 are driven and the pinch roller 3 and reversely rotatable roller 1 rotate therewith and the torque limiter 14 is slipping. In this state, F2 tends to rotate the pinch roller 3 in a clockwise direction (a direction for urging the pinch roller against the feed roller 32) with respect to the support shaft 8 with a torque of F2 (r2+a') and rotate the gear 10 in a clockwise direction (a direction for urging the pinch roller against the feed roller 32) with a torque of $$|T'| = \frac{1}{\eta 1} TR$$

and therefore, the balance of the moment of the pinch roller 3 about the support shaft 8 is $$(N' - W')b' - F2(r2 + a') - \frac{1}{\eta 1} TR = 0$$

Solving this with respect to N', $$N' = W' + F2\frac{r2 + a'}{b'} + \frac{1}{\eta 1 b'} TR,$$

where $$F2 = \frac{1}{r2} \cdot \frac{1}{\eta}$$

TR and therefore, when this is substituted for the above equation, $$N' = W' + \left( \frac{r2 + a'}{\eta r2 b'} + \frac{1}{\eta 1 b'} \right) TR \quad \text{(x)}$$

This equation (x) is an equation which represents the true pressure contact force N' (in the operative state of the rollers) between the pinch roller 3 and the feed roller 32. Like expression (vii) which represents the pressure contact force of the reversely rotatable roller 1, it will be seen that when the value of TR varies, the value of N' also varies. In the present embodiment, $$r2 = 0.8 \text{ cm}, a' = 0.8 \text{ cm}, b' = 0.95 \text{ cm}$$
$$\eta 1 = 2.0,$$
$$\eta = \frac{33}{16} \times \frac{47}{22} \times \frac{27}{29} = 4.1$$

and therefore, $$\begin{aligned} \frac{\Delta N'}{\Delta TR} &= \frac{r2 + a'}{\eta r2 b'} + \frac{1}{\eta 1 b'} \quad \text{(xi)} \\ &= \frac{0.8 + 0.8}{4.1 \times 0.8 \times 0.95} + \frac{1}{2.0 \times 0.95}, \\ &= 0.513 + 0.526 \\ &= 1.04 \text{ cm}^{-1} \end{aligned}$$

and when TR becomes strong and the sheet returning force of the reversely rotatable roller 1 becomes strong, automatic adjustment is effected so that the pressure contact force N' of the pinch roller may also become strong and the feeding force of the feed roller may increase. Thereby, a normal (free of a bad feeding speed) feeding operation is realized within a wide range of TR.

Figure 9:
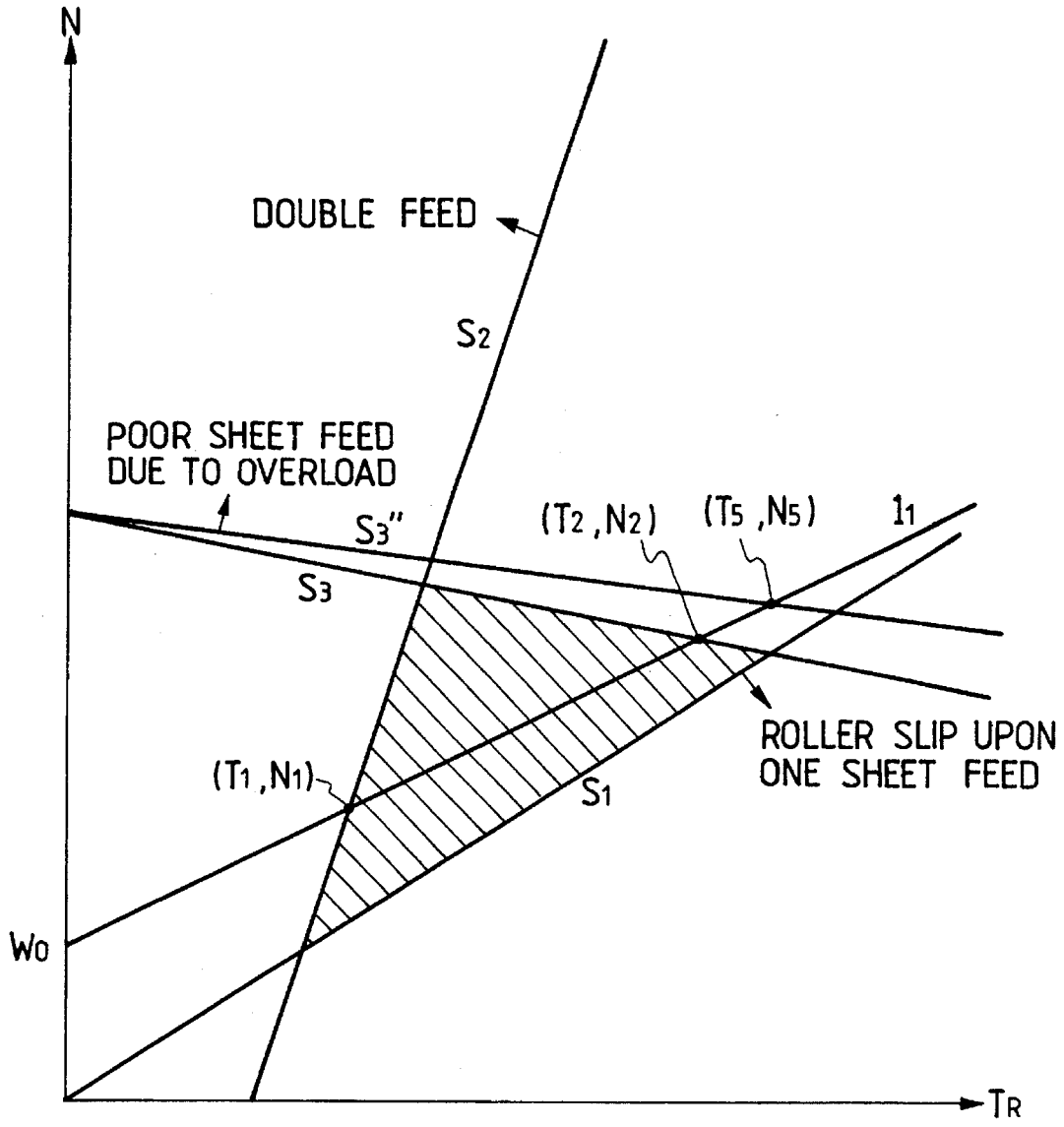
FIG. 9 is a graph showing the ranges of TR and N in which separation and feeding can be normally effected.
Figure 12:
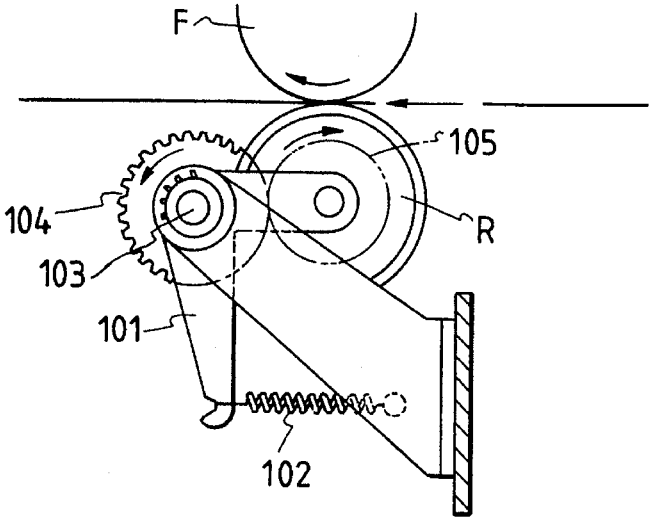
FIG. 12 PRIOR ART
FIG. 12 shows an example of the reversely rotatable roller type sheet feeding apparatus according to the prior art.
Figure 13:
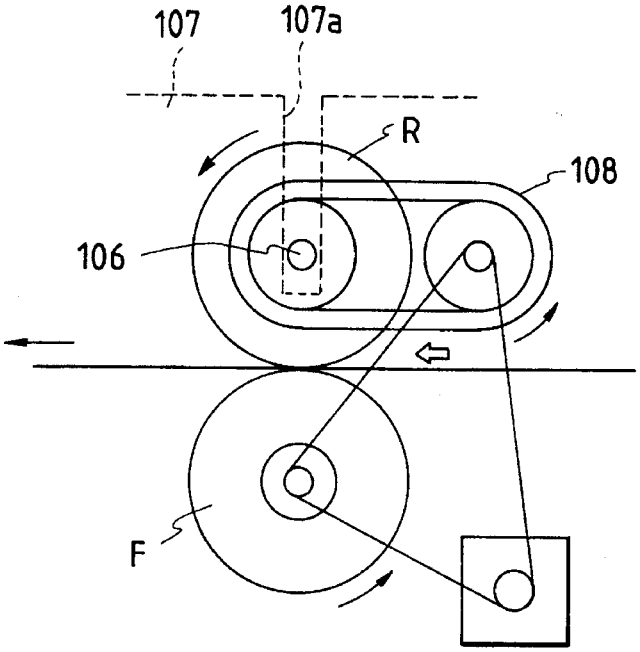
FIG. 13 PRIOR ART
FIG. 13 shows another example of the reversely rotatable roller type sheet feeding apparatus according to the prior art.

This will now be described with reference to FIG. 9. FIG. 9 is a graph in which a straight line S3" representing the effect of the present invention is added to the same graph as FIG. 7. According to the present invention, when the value of TR deflects greatly, the pressure contact force N' of the pinch roller becomes strong and the limit of the poor sheet feed due to overload, i.e., the upper limit of the allowable pressure contact force N of the reversely rotatable roller, becomes high and therefore, the straight line S3 indicating the area of poor sheet feed due to overload is improved as indicated by S3" and the upper limit value of the torque limiter 14 which can be used rises from T2 to T5.

That is, by the present invention, the range of the torque limiter 14 which can be used is widened from (T2-T1) to (T5-T1). Further, if required, the values of r2, a', b', η1 and η may be changed to easily adjust the value of $$\frac{\Delta N'}{\Delta TR}$$

In an automatic sheet feeding apparatus, paper powder and the ink or the like of printed matters may adhere to rollers while a number of sheets are fed, whereby the coefficients of friction of the rollers may be reduced to give rise to a trouble. When particularly the coefficient of friction of the feed roller 32 is reduced, a bad feeding speed will occur, and describing this with reference to FIG. 7, it corresponds to the fact that the aforementioned straight line S3 fluctuates as indicated by S3' in the same figure and the area of TR and N in which normal separation and feeding can be accomplished (the area indicated by hatching) becomes narrow.

So, in the present embodiment, the material of the feed roller 32 is changed so that paper powder or the like may not adhere to this roller, whereby the coefficient of friction of the pinch roller 3 may be made greater than the coefficient of friction of the feed roller 32 so that the pinch roller 3 may, as it were, clean the feed roller 32. Thereby, the area in which normal separation and feeding can be accomplished is prevented from becoming narrow as described above and thus, the initial performance can be maintained for a long period without the cleaning or interchange of the feed roller 32.

In the present embodiment, the reversely rotatable roller 1 and the separating roller 30 are formed of silicone rubber of the same kind and therefore, the fluctuation of F1 is little and both of the control of condition (i) and the control of conditions (ii) and (iii) are easy because F3=F4. Further, silicone rubber has the characteristic that the reduction in the coefficient of friction thereof is small relative to silicone oil adhering to copying paper or the like, and there is the effect that copying paper or the like to which silicone oil adheres can be fed stably. Also, even a curled sheet can be fed by the guides 23*a* and 23*b* without its leading end being turned over. Also, the driving of the reversely rotatable roller 1 is provided by the pinch roller 3 and the construction thereof is made independent as the reversely rotatable roller unit and therefore, as previously described, the liberation of the upper original guide unit becomes easy, and its simple mechanism leads to low manufacturing costs and a low failure rate as well as good interchangeability of the unit.

Also, in order to make the coefficient of friction of the pinch roller 3 greater than the coefficient of friction of the feed roller 32, in the present embodiment, discrete kinds of rubber are used as the materials of the respective rollers, but alternatively, use may be made of the same kinds of rubber differing in hardness. Generally, in the same kinds of rubber, lower hardness results in a greater coefficient of friction, and by the utilization of this, the pinch roller is formed of rubber of lower hardness than the rubber of the feed roller 32 to thereby make the coefficient of friction thereof greater. In this case, there are the following effects: (1) the feed roller 32 of which the feed accuracy is required is harder and therefore, the deformation (a variation in the diameter) thereof is little and it is difficult for poor feed to occur; and (2) use is made of basically the same kinds of rubber and therefore, the variations in various natures including hardness with the lapse of time are similar and it is difficult for the balance between the initial coefficients of friction to be destroyed.

Figure 10:
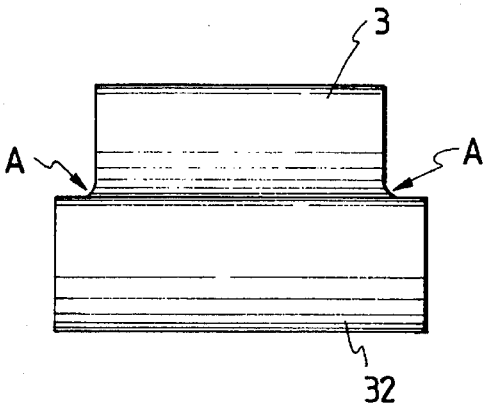
FIG. 10 shows an example of the contact state between a pinch roller and a feed roller in the device shown in FIG. 2.
Figure 11:
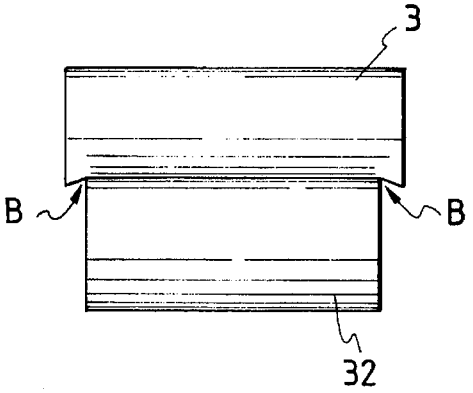
FIG. 11 shows another example of the contact state between the pinch roller and the feed roller.

Further, in this case, if the width of the pinch roller 3 of lower hardness is made smaller than that of the feed roller 32, the deformation of the portion of contact between the pinch roller 3 and the feed roller 32 will follow the feed roller 32 (a portion A) as shown in FIG. 10 and therefore, sheets will not be wrinkled. If the pinch roller 3 of lower hardness is made wider, the opposite end portions of the feed roller 32 will eat into the pinch roller 3 to form a level difference as shown in FIG. 11, and sheets will be wrinkled, and this is not preferable.

The construction of the image reading portion X in the present embodiment, as shown in FIG. 1, comprises a light source 51, reflecting mirrors 52 and 53, a lens 54, a photoelectric conversion element 55 such a s a CCD, etc.

Other Embodiment

A second embodiment will now be described.

As can be seen from the calculation of equations (x) and (xi), in the previous embodiment, both of a force $$\left( \frac{1}{\eta 1b'} TR \right)$$

created by the reverse drive transmitting force from the support shaft to the pinch roller 3 in the direction for urging the pinch roller 3 against the feed roller 32 and a force $$\left( \frac{r2 + a'}{\eta r2b'} TR \right)$$

created by the frictional force received from the feed roller 32 by the pinch roller 3 in the direction for urging the pinch roller 3 against the feed roller 32 assume positive values and the resultant force thereof is made positive, but the operational effect of the present invention can also be displayed by making one of the two forces zero or negative and yet making the resultant force thereof positive.

For example, in the previous embodiment, the support shaft 8 is disposed downstream of the pinch roller 3 with respect to the sheet feeding direction and therefore, the force $$\frac{r2 + a'}{\eta r2b'} TR$$

created by the frictional force of the pinch roller 3 is positive, but if within a range in which the resultant force becomes positive, the support shaft 8 may be disposed upstream of the pinch roller 3 and the force created by the frictional force of the pinch roller 3 may be made negative. Like this, the present invention has a great degree of freedom in designing.

If the above-described construction is adopted, a torque limiter of a torque limit value over a wide range (great in irregularity and inexpensive) is used and yet good sheet feeding can be realized without a bad feeding speed being caused. Further, automatic adjustment is effected so that the pressure contact force of the pinch roller may be strong only when the torque value is great and therefore, the load of the feed roller (the bearing and the drive transmitting system) need not be increased and it becomes unnecessary to estimate the torque margin of the drive motor excessively (the safety rate when mass production is considered can be chosen low), and this leads to the effect that the manufacturing costs become low and the durability of the device can be increased.

What is claimed is:

1. A sheet supply apparatus, comprising:

a separation roller rotating in a direction to feed out a sheet;

a reverse rotation roller, supported by a first rotatable arm, rotating in a direction reverse to the feed-out direction, said reverse rotation roller cooperating with said separation roller to separate the fed out sheet one by one;

a feed roller provided downstream of said separation roller and rotating in a direction to convey the sheet fed out by the separation roller;

a pinch roller, supported by a second rotatable arm, abutting said feed roller to convey the sheet fed out by said separation roller, said pinch roller receiving a drive force from said feed roller;

a drive force transmission means for transmitting a drive force from said pinch roller to said reverse rotation roller; and a frame for supporting said reverse rotation roller, pinch roller and drive force transmission means, said frame being movably attached to a body of said sheet supply apparatus so as to expose a convey path in which the sheet is conveyed.

2. A sheet supply apparatus according to claim 1, wherein the convey path includes said separation roller and said reverse rotation roller abutted thereagainst, and said feed roller and said pinch roller abutted thereagainst, so that said reverse rotation roller is separated from said separation roller and said pinch roller is separated from said feed roller when said convey path is exposed.

3. A sheet supply apparatus according to claim 2, wherein said frame has a guide portion for guiding an upper surface of the sheet to be conveyed.

4. A sheet supply apparatus according to claim 2, wherein said frame is rotatably attached about an axis transverse to a sheet feeding direction, and the convey path is exposed upon an upward rotation of said frame.

5. A sheet supply apparatus according to claim 4, wherein said first rotatable arm is attached to a support shaft disposed downstream of said separation roller, and being urged so that said reverse rotation roller is abutted onto said separation roller by said first urging member.

6. A sheet supply apparatus according to claim 5, wherein said second rotatable arm is attached to said support shaft, and being urged so that pinch roller is abutted onto said feed roller by said second urging member.

7. A sheet supply apparatus according to claim 1, wherein said drive force transmission means includes a torque limiter interrupting transmission of a drive torque over a predetermined torque value.

8. A sheet supply apparatus according to claim 1, wherein said drive force transmission means has a gear train transmitting the drive force.

9. A sheet supply apparatus, comprising:

a separation roller provided on said apparatus and rotating in a direction to feed out a sheet;

a reverse rotation roller rotating in a direction reverse to the feed-out direction, said reverse rotation roller cooperating with said separation roller to separate the fed out sheet;

a feed roller provided downstream of said separation roller and rotating in a direction to convey the sheet fed out by the separation roller;

a pinch roller abutting said feed roller for conveying the sheet fed out by said separation roller;

a drive force transmission means for transmitting a drive force from said pinch roller to said reverse rotation roller; and a frame for supporting said reverse rotation roller, pinch roller and drive force transmission means so as to form a single independent unit of said reverse rotation roller, pinch roller and drive force transmitting means, wherein the single independent unit is removable from said apparatus.

10. A sheet supply apparatus according to claim 9, wherein said drive force transmission means has a torque limiter interrupting transmission of a drive torque over a predetermined torque value.

11. A sheet supply apparatus according to claim 10, wherein said reverse rotation roller and said pinch roller are respectively disposed over said separating roller and said supply roller, and said frame has a guide portion for guiding an upper surface of the sheet to be conveyed.

12. An image reading apparatus, comprising:

a separation roller rotating in a direction to feed out a sheet;

a reverse rotation roller, supported by a first rotatable arm, rotating in a direction reverse to the feed-out direction, said reverse rotation roller cooperating with said separation roller to separate the fed out sheet;

a feed roller provided downstream of said separation roller and rotating in a direction to convey the sheet fed out by the separation roller;

a pinch roller, supported by a second rotatable arm, abutting said feed roller to convey the sheet fed out by said separation roller, said pinch roller receiving a drive force from said feed roller;

a drive force transmission means for transmitting a drive force from said pinch roller to said reverse rotation roller;

a frame for supporting said reverse rotation roller, pinch roller and drive force transmission means, said frame being movably attached to a body of said image reading apparatus so as to expose a convey path in which the sheet is conveyed; and image read means for reading an image of the sheet fed out by said feed roller and said pinch roller.

13. An image reading apparatus, comprising:

a separation roller provided on said apparatus and rotating in a direction to feed out a sheet;

a reverse rotation roller rotating in a direction reverse to the feed-out direction, said reverse rotation roller cooperating with said separation roller to separate the fed out sheet;

a feed roller provided downstream of said separation roller and rotating in a direction to convey the sheet fed out by the separation roller;

a pinch roller abutting said feed roller to convey the sheet fed out by said separation roller;

a drive force transmission means for transmitting a drive force from said pinch roller to said reverse rotation roller;

a frame for supporting said reverse rotation roller, pinch roller and drive force transmission means so as to form a single independent unit of said reverse roller, pinch roller and drive force transmitting means, wherein the single independent unit is removable from said apparatus; and image read means for reading an image of the sheet fed out by said feed roller and said pinch roller.

* * * * *

UNITED STATES PATENT AND TRADEMARK OFFICE

CERTIFICATE OF CORRECTION

PATENT NO. : 5,474,287
DATED : December 12, 1995
INVENTOR(S) : KOJI TAKAHASHI

It is certified that error appears in the above-indentified patent and that said Letters Patent is hereby corrected as shown below:

On the title page item [56], "241487 9/1990 Japan: should read --2-41487 9/1990 Japan.

Column 5,
line 29, "friction" should read --friction between--;
line 30, "30 F1" should read --30 .... F1--;
line 32, "F2" should read -- ... F2--;
line 34, "36 F3" should read --36 ... F3--;
line 35, "36 F4" should read --36 ... F4--;
line 36, "36 F5" should read --36 ... F5--;
line 37, "36 F6" should read --36 ... F6--;
line 38, "36 F7" should read --36 ... F7--; and
line 65, "t here is" should read --there is--.

Column 9,
line 58, "= 1.04cm$^{-1}$" should read -- = 1.04cm$^{-1}$ --- (xi)--.

Signed and Sealed this

Thirtieth Day of April, 1996

Bruce Lehman

Attest:

BRUCE LEHMAN

Attesting Officer

Commissioner of Patents and Trademarks